United States Patent [19]

Cloud

[11] 4,046,194

[45] Sept. 6, 1977

[54] ELECTROLINKING METHOD FOR IMPROVING PERMEABILITY OF HYDROCARBON FORMATION

[75] Inventor: Wayne B. Cloud, Dallas, Tex.

[73] Assignee: Mobil Oil Corporation, New York, N.Y.

[21] Appl. No.: 682,706

[22] Filed: May 3, 1976

[51] Int. Cl.[2] ..... E21B 43/00; E21B 43/26

[52] U.S. Cl. ..... 166/248; 166/271

[58] Field of Search ..... 166/248, 271, 52, 60; 299/2

[56] References Cited

U.S. PATENT DOCUMENTS

| | | | |
|---|---|---|---|
| 2,795,279 | 6/1957 | Sarapuu | 166/248 |
| 3,106,244 | 10/1963 | Parker | 166/248 |
| 3,169,577 | 2/1965 | Sarapuu | 166/248 |
| 3,236,304 | 2/1966 | Sarapuu | 166/248 |
| 3,620,300 | 11/1971 | Crowson | 166/248 |
| 3,696,866 | 10/1972 | Dryden | 166/248 |
| 3,718,186 | 2/1973 | Brandon | 166/248 |

*Primary Examiner*—Stephen J. Novosad
*Assistant Examiner*—George A. Suchfield
*Attorney, Agent, or Firm*—C. A. Huggett; Drude Faulconer

[57] ABSTRACT

A method of improving the permeability of a hydrocarbon bearing formation such as a coal seam by electrolinking a first well and a second well which have been drilled into the formation. Both wells are completed with similar strings of casing. The portion of the casing string which passes into or through the formation is comprised of alternating sections of electrically conductive and nonconductive material. An electrode is lowered into each well into contact with one of the electrically conductive sections. Current is then flowed between the electrodes in the wells until a permeable path through the formation is established. Then one or both electrodes are moved into contact with different conductive sections within the respective wells and the procedure is repeated.

12 Claims, 4 Drawing Figures

ELECTROLINKING METHOD FOR IMPROVING PERMEABILITY OF HYDROCARBON FORMATION

BACKGROUND OF THE INVENTION

The present invention relates to a method of improving the permeability of a hydrocarbon bearing formation and more particularly relates to an electrolinking method for improving the permeability of a formation such as a coal seam in which an in situ gasification operation is to be carried out.

Due to the nature and position of certain hydrocarbon bearing formations (e.g., deep lying coal seams), it is sometimes desirable to recover the hydrocarbons by gasifying the hydrocarbons in situ and producing the resulting products. Typically, this is done by circulating a gasifying agent (e.g., heated gas) between an injection well and a production well which have been completed into the formation. Unfortunately, however, may of these formations are relatively impermeable and must be treated in some way to establish the necessary fluid communication between wells before a successful in situ gasification operation can be performed.

Several methods are known for improving permeability between wells in such hydrocarbon formations, one of which is commonly referred to as "electrolinking." As explained in "A Current Appraisal of Underground Coal Gasification," Arthur D. Little, Inc., Apr. 17, 1972 (PB-209, 274) pp. 21 et sec., (distributed by National Technical Information Service of U.S. Department of Commerce), electrolinking is a process wherein electrodes are installed within a formation such as a coal seam at a given spacing. Electric current is passed between the electrodes which carbonizes the coal along the path taken by the electricity and this, in turn, provides a path of increased permeability within the formation through which gases may flow.

In establishing electrolinked paths through a formation, normally "point " sources and sinks are used which provide a substantially small path in relation to the thickness of the formation. Since it is desirable to increase the permeability in as much of the formation as possible, the more individual paths established between wells for the flow of current, the better improvement will be in the overall permeability of the formation.

SUMMARY OF THE INVENTION

The present invention provides a method of electrolinking a first or injection well and a second or production well which are completed into a hydrocarbon bearing formation so that a plurality of permeable paths are established between said wells.

Specifically, at least two wells are drilled into a hydrocarbon bearing formation, e.g., a coal seam. Each of the wells is completed with a string of casing which is constructed so that the portion of the casing which passes into or through the coal seam is comprised of alternating sections of electrically conductive and nonconductive materials. For example, the lower portion of the casing may be made up of sections of nonconductive conduit, e.g., fiberglass or plastic pipe, joined together by electrically conductive, steel couplings or collars. Preferably, the electrically conductive sections are spaced at least six feet from each other throughout the coal seam to insure that they are adequately insulated from each other.

After the casings are positioned in their respective wells, an electrode is lowered into each of the casings to a position where an electrode will contact an electrically conductive section within each of the respective wells. The actual details of the electrodes, themselves, form no part of the present invention and an electrode may be of various constructions as long as it can readily moved from position to position within the casing. For example, the electrode may be mounted on a support such as a tubing so that it is continuously biased outward into firm contact with the inside of the casing.

Electric current is passed from the electrode in the first well, through the conductive section of casing with which it is in contact, and into the formation. The current follows a defined path through the formation to the conductive section of casing in the second well with which the electrode therein is in contact. The flow of current is continued until sufficient carbonization of the coal has taken place along the path between the electrodes to provide adequate permeability for the subsequent flow of gas or the like.

At this point, the electrode in either well or both is then moved into contact with a different conductive section of the casing to thereby establish a new path for current flow between wells. With this procedure, several permeable paths are established through the formation by merely repositioning the electrodes in each well. Also, by completing all the wells of a designated pattern of wells in accordance with the present invention, the permeability of a large portion of a coal seam can be readily accomplished with only a minimum of electrodes. Still further, the present invention can be applied to patterns of inclined or horizontally completed wells which have been completed into a coal seam by means of directional drilling or from a vertical shaft or from a point where the seam outcrops at or near the surface.

BRIEF DESCRIPTION OF THE DRAWINGS

The actual construction, operation, and apparent advantages of the present invention will be better understood by referring to the drawings in which like numerals identify like parts and in which.

DESCRIPTION OF THE PREFERRED EMBODIMENTS

Figure 1:
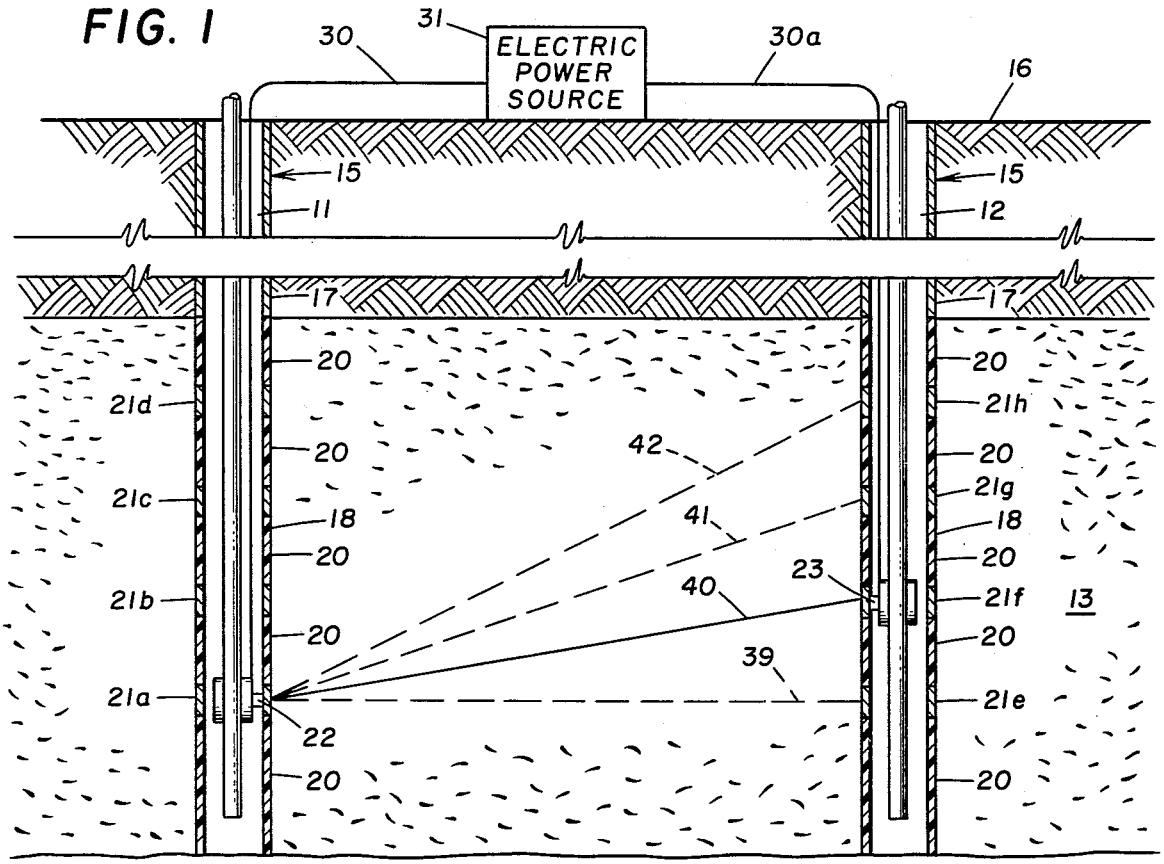
FIG. 1 is a cross-sectional view of two wells being electrolinked in accordance with the present invention.

Referring more particularly to the drawings, FIG. 1 discloses a first well 11 and a second well 12 which have been drilled into and substantially perpendicular to the bedding plane of a hydrocarbon bearing formation, e.g., coal seam 13. In accordance with the present invention, both wells 11, 12 have been completed with similar strings of casing 15. Casing 15 has an upper portion 17 which extends from surface 16 to coal seam 13 and a lower portion 18 which extends into or through coal seam 13. Upper portion 17 may be comprised of any known conduit material, e.g., preferably standard steel casing. Lower portion 18, however, is constructed from alternating lengths of electrically non-conductive sections 20, e.g., fiberglass or plastic pipe, and electrically conductive sections 21, e.g., steel couplings or collars. Preferably, nonconductive sections 20 are at least six-feet long so that conductive sections 21 are adequately insulated from each other.

Figure 2:
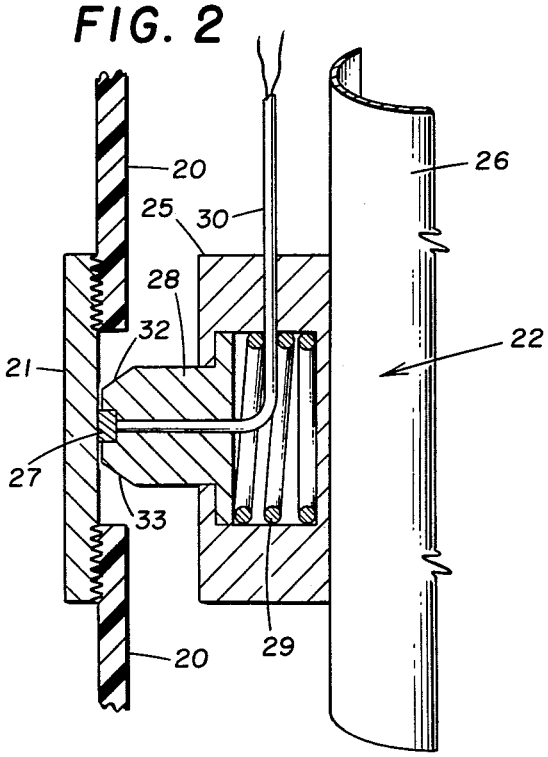
FIG. 2 is a partial view, partly in section, of an electrode used in the present invention.

After wells 11, 12 have been completed with casings 15, electrode 22 is lowered into well 11 and electrode 23 is lowered into well 12. The actual construction of the electrodes forms no part of the present invention and may take any form which allows the electrodes to firmly contact the inside of casing 15 but at the same time allows the electrodes to be readily movable within the wells. One such electrode 22 is shown in FIG. 2 wherein housing 25 of preferably nonconductive material is affixed on support 26, e.g., a tubing string. Terminal 27 is secured in nonconductive member 28 which in turn is movably mounted in housing 25 and is normally biased outward by spring 29. An electrical conductor 30, e.g., insulated cable, extends from electric power source 31 on surface 16, through housing 25, and is connected to terminal 27. Electrode 23 is constructed similarly as electrode 22 and is connected to electric power source 31 by conductor 30*a*.

As electrodes 22, 23 are lowered in wells 11, 12, respectively, members 28 are normally biased outward into contact with the inside of casing 15. As an electrode moves adjacent a collar 21, member 28 is biased into contact therewith so that terminal 27 is forced into firm contact with collar 21. The upper and lower surfaces 32, 33 of member 28 are beveled so that upward or downward movement of support 26 will cause member 28 to be cammed out of collar 21, thereby readily permitting movement of the electrodes within casing 15.

As shown in FIG. 1, current is supplied from source 31 through conductor 30 to electrode 22 in well 11 and passes through conductive section 21*a* into coal seam 13. The current follows path 40 through coal seam 13 to electrode 23 which is in contact with conductive section 21f in well 12. The flow of current is continued until the coal in path 40 has carbonized sufficiently to substantially improve the permeability of coal seam 13 along said path. The actual amount of current supplied and its duration will be determined by the actual characteristics of formation 13, spacing between wells 11 and 12, amount of current available, etc., as is the case in other known electrolinking methods.

Once desired permeability has been established along path 40, electrode 23 is moved into contact with another of the conductive sections within well 12 to thereby establish another path for current through formation 13, e.g., electrode 23 is moved into contact with conductive section 21g to establish path 41.

Figure 3:
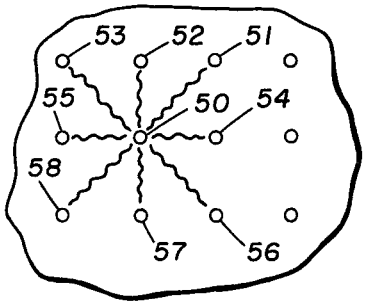
FIG. 3 is a plan view of a pattern of vertically drilled wells in which the present invention is applied.

It can be seen that by repositioning electrode 23 at each of conductive sections 21*e* –21*h*, a plurality of individual paths 39–42, respectively, are established between well 12 and conductive section 21*a* in well 11 through which current may flow. Likewise, by repositioning electrode 22 at each of conductive sections 21*a*–21*d* in well 11, and then repositioning electrode 23 at conductive sections 21*e*–21*h* within well 12, additional permeable paths are established through coal seam 13. As illustrated in FIG. 1, each casing 15 has four conductive sections which provide for a total of sixteen different paths through coal seam 13.

Where FIG. 1 illustrates the present invention as applied between two wells, FIG. 3 disclosed how the invention may be applied to a pattern of wells, e.g., nine-spot pattern. Each well in the pattern is completed with casing similar to that of casing 15 in FIG. 1. Electrode 22 is lowered in central well 50 with electrode 23 first being lowered in an adjacent well, e.g., 51. After positioning the electrodes in each well to establish all available paths between wells 50 and 51, electrode 23 is then moved to a second well, e.g., 52. This procedure is repeated until a plurality of permeable paths have been established between well 50 and all of surrounding wells 51–58.

Figure 4:
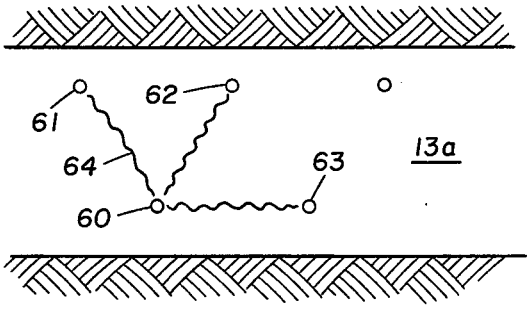
FIG. 4 is a sectional view of a pattern of horizontally completed wells into a coal seam or the like in which the present invention is applied.

FIG. 4 discloses the present invention as applied between inclined or horizontally completed wells that have been drilled at spaced intervals into and substantially parallel to the bedding plane of coal seam 13*a*. The wells can be drilled horizontally from a central mine shaft or directly into a coal seam where it outcrops near the surface or the wells may be directionally drilled into the seam from the surface. All of the wells are completed with casings similar to casing 15 described above. Electrode 22 is moved laterally into well 60 while electrode 23 is positioned in well 61. The electrodes are moved into contact with all of the available conductive sections of the respective casings to thereby establish a plurality of paths, e.g., 64 (only path shown), between wells 60 and 61. Electrode 23 is then moved to well 62, well 63, etc., and the procedure repeated in each well until all available paths between adjacent wells have been established.

What is claimed is:

1. A method of improving the permeability of a hydrocarbon bearing formation such as a coal seam or the like, said method comprising:

drilling a first well into said formation;

drilling a second well into said formation spaced from said first well;

completing each of said wells with a string of casing having a portion passing into said formation comprised of alternating sections of conduit made from electrically conductive material and electrically nonconductive material, said strings of casing each having more than one electrically conductive section lying within said formation;

lowering an electrode in said first well and into contact with one of said electrically conductive sections of casing within said formation;

lowering an electrode in said second well and into contact with one of said electrically conductive sections of casing within said second well; and flowing electric current between said electrodes.

2. The method of claim 1 including:

ceasing flow of electric current between said electrodes;

moving one of said electrodes into contact with a different electrically conductive section in its respective well; and flowing electric current between said electrodes.

3. The method of claim 2 including:

ceasing flow of electric current between said electrodes;

moving the other of said electrodes into contact with a different electrically conductive section in its respective well; and flowing electric current between said electrodes.

4. The method of claim 1 wherein said electrically nonconductive material is comprised of plastic pipe and said electrically conductive material is comprised of steel collars which couple lengths of said plastic pipe together.

5. The method of claim 1 wherein said first well and said second well are completed substantially perpendicular to the bedding plane of said formation.

6. The method of claim 1 wherein said first well and said second well are completely substantially parallel to the bedding plane of said formation.

7. A method of improving the permeability of a hydrocarbon bearing formation such as a coal seam or the like, said method comprising:

completing a first and a second well within said formation with similar strings of casing, each string of casing having a portion thereof which passes into said formation comprised of alternating sections of conduit made from electrically conductive material and electrically nonconductive material, said strings of casing each having more than one electrically conductive section lying within said formation;

lowering an electrode in said first well and into contact with one of said electrically conductive sections of casing within said formation;

lowering an electrode in said second well and into contact with one of said electrically conductive sections of casing within said second well; and flowing electric current between said electrodes.

8. The method of claim 7 including:

ceasing flow of electric current between said electrodes;

moving one of said electrodes into contact with a different electrically conductive section in its respective well; and flowing electric current between said electrodes.

9. The method of claim 8 including:

ceasing flow of electric current between said electrodes;

moving the other of said electrodes into contact with a different electrically conductive section in its respective well; and flowing electric current between said electrodes.

10. The method of claim 7 wherein said electrically nonconductive material is comprised of plastic pipe and said electrically conductive material is comprised of steel collars which couple lengths of said plastic pipe together.

11. The method of claim 7 wherein said first well and said second well are contemplated substantially perpendicular to the bedding plane of said formation.

12. The method of claim 7 wherein said first well and said second well are completed substantially parallel to the bedding plane of said formation.

* * * * *